US007503199B2

(12) United States Patent
Smith

(10) Patent No.: US 7,503,199 B2
(45) Date of Patent: Mar. 17, 2009

(54) PULLEY BLOCK STRAPS

(75) Inventor: Giles Smith, Burnham-on-Crouch (GB)

(73) Assignee: Allen Brothers (Fittings) Limited (GB)

( * ) Notice: Subject to any disclaimer, the term of this patent is extended or adjusted under 35 U.S.C. 154(b) by 463 days.

(21) Appl. No.: 11/138,962

(22) Filed: May 25, 2005

(65) Prior Publication Data

US 2005/0263748 A1 Dec. 1, 2005

(30) Foreign Application Priority Data

May 28, 2004 (GB) ..... 0411959.0

(51) Int. Cl.
*B21D 22/00* (2006.01)

(52) U.S. Cl. ..... 72/356; 72/379.2

(58) Field of Classification Search ..... 72/379.2, 72/411, 360, 470, 476, 481.2, 481.3, 356
See application file for complete search history.

(56) References Cited

U.S. PATENT DOCUMENTS 2,590,229 A * 3/1952 Card ..... 72/353.2
3,545,248 A * 12/1970 Whiteside ..... 72/324

FOREIGN PATENT DOCUMENTS

GB 980861 3/1961
GB 2 356912 8/1999

OTHER PUBLICATIONS

UK Search Report dated Aug. 17, 2005 (1 page).
Holt Blocks Brochure, www.holtallen.com, 2003/2004, pp. 5-6.

* cited by examiner

*Primary Examiner*—Dana Ross
*Assistant Examiner*—Debra M Sullivan
(74) *Attorney, Agent, or Firm*—Renner, Kenner, Greive, Bobak, Taylor & Weber

(57) ABSTRACT

A method of forming a U-shaped strap for a pulley block starts with providing a strip-like blank of a metal which may be work-hardened and having an elongate central region and two end portions extending one from each end of the two opposed ends of the central region. Such a blank may be formed by a stamping operation typically from a suitable grade of stainless steel. The central region of the blank is bent round into a U-shape with the two end portions substantially parallel. Either concurrently with the bending operation or subsequent thereto, the central region is subjected to a cold-forming operation in the transverse direction of the central region, to reduce the width thereof and to provide a radius to the long edges of that central region.

11 Claims, 3 Drawing Sheets

PRIOR ART 25
26
27
28
29
30
31
32
33

PULLEY BLOCK STRAPS

BACKGROUND OF THE INVENTION a) Field of the Invention

This invention relates to a method of forming a U-shaped strap for a pulley block having a pair of opposed cheeks and a sheave rotatably mounted therebetween. This invention also relates to a strap formed by the method, and to a pulley block when incorporating such a strap.

Though a pulley block of the kind with which this invention is concerned may be used in a variety of circumstances, it has a particular application in relation to racing dinghies. As such, the invention will be described exclusively with reference to pulley blocks for that use, even though the invention is not to be regarded as limited thereto.

b) Description of the Prior Art

Pulley blocks are used extensively on the running rigging of racing dinghies, to assist in the hoisting and trimming of the sails, as well as for other lines used on dinghies. Such pulley blocks are required to have very low friction in order to minimise losses and also to have relatively low weights. Further, pulley blocks used on racing dinghies are frequently highly stressed and so must display great strength in order not to fail at inconvenient times.

A common form of pulley block has a body defining a pair of opposed cheeks between which is rotatably mounted a sheave, the cheeks being held apart at the required spacing by both a boss within the bore of the sheave and a bridging member external to the sheave. A generally U-shaped metallic strap having a base section from which extends a pair of arms is fitted to the body so that each arm overlies the external surface of a respective cheek, the base section of the strap extending over the bridging member. The strap is usually secured to the body by means of at least one through-fastener, which also serves as a shaft on which the sheave is mounted by suitable bearings. The part of the strap extending over the bridging member is adapted for direct or indirect connection to some other component with which the block is to be associated, such that the load imparted to the sheave by a line passing therearound is transferred through the shaft to the strap, and then to that other component.

Recently, blocks have been introduced which have an annular sheave supported by races defined between the outwardly-directed faces of the sheave and the inwardly-directed faces of the cheeks. As such, there is no need to provide a shaft for rotationally mounting the sheave, so that the load is transferred indirectly from the sheave to the strap, through the cheeks. As a consequence, it has been possible to shorten the length of the arms of the strap, but the attachment of the strap to the cheeks must be enhanced, by providing a multiplicity of fasteners extending through the arms of the strap, adjacent but within the inner periphery of the sheave or through the bridging member. These measures can allow the achievement of a reduction in weight of a pulley block as compared to a more conventional construction.

A pulley block of the kind described above is usually connected to some other component by using a metal shackle engaged with the block strap, which increases the weight of the overall assembly. There is a significantly high line-load between the shackle pin and the base section of the U-shaped strap and this can lead to deformation of the strap, which in turn will affect the performance of the block, when in use. In order to eliminate the need for a shackle, frequently a block will be tied by a cord to some other component and to minimise the likelihood of the cord being damaged by the strap, it is known to give the strap a concave cross-section, when viewed externally of the block. The rounded surface of the strap increases its rigidity and also reduces the angle through which a cord is forced when under load so reducing the breaking force on the cord, but it has the effect of reducing the contact area between the strap and a shackle pin to a point-contact, increasing force on the strap at the interface between the strap and a shackle.

The U-shaped strap is conventionally formed by cutting a strip from a sheet of metal such as stainless steel, usually by a stamping operation which also will form the required holes through the strap. The strap is then placed in a press and formed to have the required finished profile. Though this may reduce the sharp edges along the length of the strap, nevertheless those edges are still likely to damage a cord used to tie the block to some other component.

BRIEF SUMMARY OF THE INVENTION

The present invention aims at providing an improved strap for use with a block, which strap is able to demonstrate high strengths and a reduced likelihood of damaging a cord which may be used to tie a block furnished with the strap to some other component.

According to one aspect of this invention, there is provided a method of forming a U-shaped strap for a pulley block, comprising:

- providing a strip-like metal blank having an elongate central region with two ends and long edges extending between said ends, and two end portions extending one from each of the two opposed ends respectively of the central region;
- bending the blank round into a U-shape so that the central region is arcuate and the two end portions are substantially parallel; and
- subjecting the central region to a cold-forming operation in a direction transverse to the long edges of the central region to reduce the width of the central region and to provide a radius to the long edges thereof.

The cold-forming operation is performed subsequent to the bending of the blank. The tooling for the cold-forming operation must be capable of processing the bent blank to obtain the central region of reduced width, together with a radius to the long edges thereof.

BRIEF DESCRIPTION OF THE DRAWINGS

The drawings show a specific embodiment of pulley block strap forming method of this invention, though only by way of example. In the drawings.

DETAILED DESCRIPTION OF THE INVENTION

Figure 1:
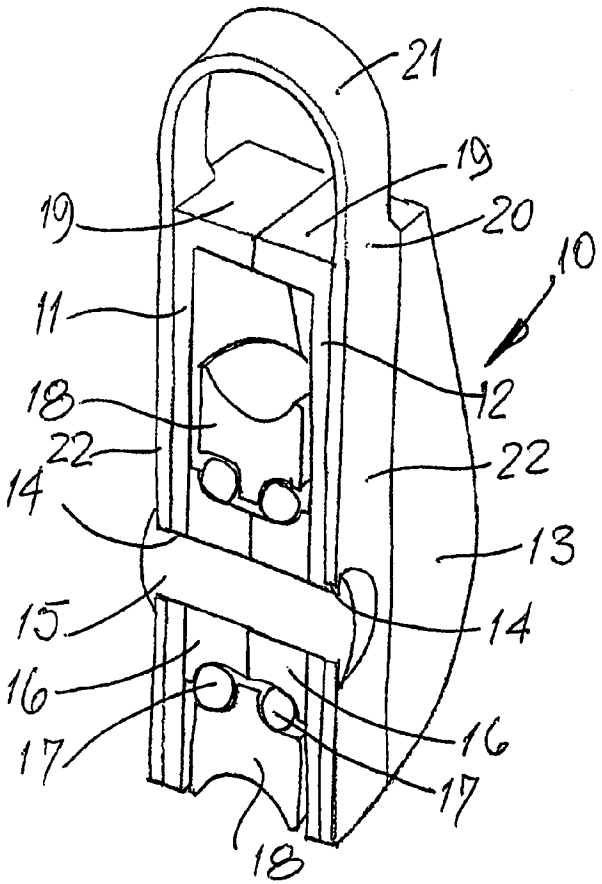
FIG 1 PRIOR ART
FIG. 1 is a sectional view through a first pulley block of a conventional design and having a simple pre-formed metal strap.

In the strap-forming process of this invention, it will be appreciated that the central region of the strip is cold-formed to provide the base section of the finished strap, which in use extends around but spaced from the bridging member of a pulley block body and so that part of the strap by means of which the block is connected to some other component. As with conventional blocks, this may be achieved either with a metal shackle, or by means of a cord tied round the base section of the strap. However, by virtue of the cold-forming operation to which the central region of the blank is subjected, the strength of that central region is enhanced and further the edge regions are radiused to reduce the likelihood of damage or chafing to a cord tied to the strap. Further, since the central region of the strap may be narrower than with a conventional strap on a block of a comparable size, but without loss of strength, when a block incorporating the strap of this invention is connected to some other component, the narrower central region of the strap allows for increased articulation for the block.

The cold-forming operation is preferably performed in such a way that the thickness of the central region is increased simultaneously with the reduction in width of the central region, as well as providing radiused long edges for that central region. For a blank where the width of each end portion is narrower than the width of the central region thereof, following completion of the cold-forming operation, the width of the central region may be no greater than the width of the end portions which define the arms for fitting to the outer surfaces of the cheeks of the block body. Preferably, the width of the central region is slightly less than the width of the end portions, at the completion of the cold-forming operation. Further, it is preferred that the inwardly-directed face of the base section of the strap is substantially flat in the direction between its long edges, so that if a block provided with the strap is used with a shackle, there will be a line contact between the strip and the shackle pin. Alternatively, the inwardly-directed face of the base section may be concave to increase its rigidity, while still avoiding a single point contact between the strap and shackle pin.

Advantageously, the cold-forming operation is performed in a press provided with a die having cooperating die parts which together define a cavity of the required finished profile of the central region of the finished strap. In practice, the die cavity may need slight modification as compared to the exact required finished profile, in view of the characteristics of the metal from which the strap is to be made, whereby the strap may be over-formed and then on removing the formed strap from the die, the strap will end up with the required profile.

The method of this invention is preferably performed on a blank cut from a metal which is susceptible to work-hardening, whereby the central region of the finished strap will display greater strength than the metal of the strip-like blank before forming. Certain grades of stainless steel are particularly susceptible to work-hardening in this way and also are resistant to the environments in which dinghy pulley blocks are frequently used. As such, it is envisaged that the method of this invention will mainly be performed to provide stainless steel straps.

This invention extends to a U-shaped strap for a pulley block whenever produced by a method of this invention as described above. The arms of the strap may be shaped during production of the blank so as to have any required profile. In particular, each arm may be profiled to interact with a formation on the side cheek of a pulley block, to assist the transfer of loads between the side cheek and the strap. Further, the invention also extends to a pulley block having a body defining a pair of side cheeks between which is mounted a rotatable sheave, the block including a U-shaped strap having end portions connected one to each cheek respectively and an arcuate central region conjoining the end portions, which strap has been produced by a method of this invention.

In order to assist an understanding of the strap-forming process of this invention, two conventional pulley blocks of this invention will now be described, which pulley blocks employ prior art straps not employing a cold-forming operation for the production thereof.

Referring to FIG. 1, there is shown in section a conventional pulley block 10 having a body formed from two similar halves 11, 12, each half defining a cheek 13. A bore 14 is formed in the central region of each cheek, a pin 15 extending through the aligned bores. A pair of inner tracks 16 are carried on the pin 15, balls 17 running on those tracks and rotatably supporting a sheave 18 between the two cheeks. Each body-half 11, 12 also defines a part of a bridging member 19 which extends over the sheave 18 at one end of the block. The bridging member 19 parts on the two body halves 11, 12 may be profiled to interengage with one another and so prevent relative rotation therebetween, about pin 15.

A generally U-shaped strap 20 has an arcuate base section 21 which extends around the bridging member 19, and a pair of arms 22 which lie alongside the outer surfaces of the cheeks 13, one of each side of the block. The entire assembly is held together by the metal pin 15 which extends through holes pre-formed in the arms 22 of the strap and also through the holes formed centrally in the cheeks. The pin 15 may be peined over as shown, to hold the assembly together, or another fastening arrangement for that pin may be provided.

As shown, there is a significant clearance between the base section 21 of the strap 20 and the bridging member 19, whereby that base section may be used for securing the block to some other component. The spacing is sufficient to accommodate the pin of a shackle, or in the alternative to permit a cord to be tied to the strap, whereby loads imparted to the block by a line passing around the sheave may be transferred through the cord to that other component. Also as shown in FIG. 1, the cross-section of the base section 21 of the strap 20 may have a slightly concave form when viewed externally of the block so as to provide a curved surface against which a tying cord may bear when under tension. Despite this, the relatively sharp edges of the strap are likely to damage a cord passing therearound, after a period of use.

Figure 2:
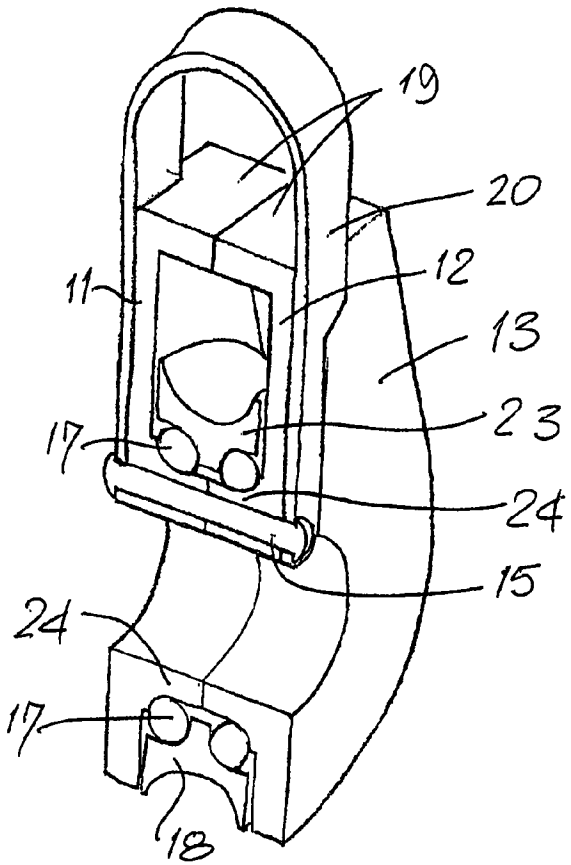
FIG. 2 is a sectional view through a second pulley block also of a conventional design but having an annular sheave, in conjunction with a pre-formed metal strap.

FIG. 2 shows another known design of pulley block, generally similar to that described above but differing in that the sheave 23 has a greater internal diameter than that shown in FIG. 1 and that the cheeks provide opposed and abutting bosses 24 on which the sheave runs. A large diameter hole passes through the aligned bosses 24 and as such, the fastening pin 15 does not extend coaxially with the sheave, but rather is displaced towards the bridging member 19. This permits the arms 22 of the strap to be relatively short, so reducing the overall weight of the block, but the base section of the strap still has the same problems as have been described above.

Figures 3, 4, 5:
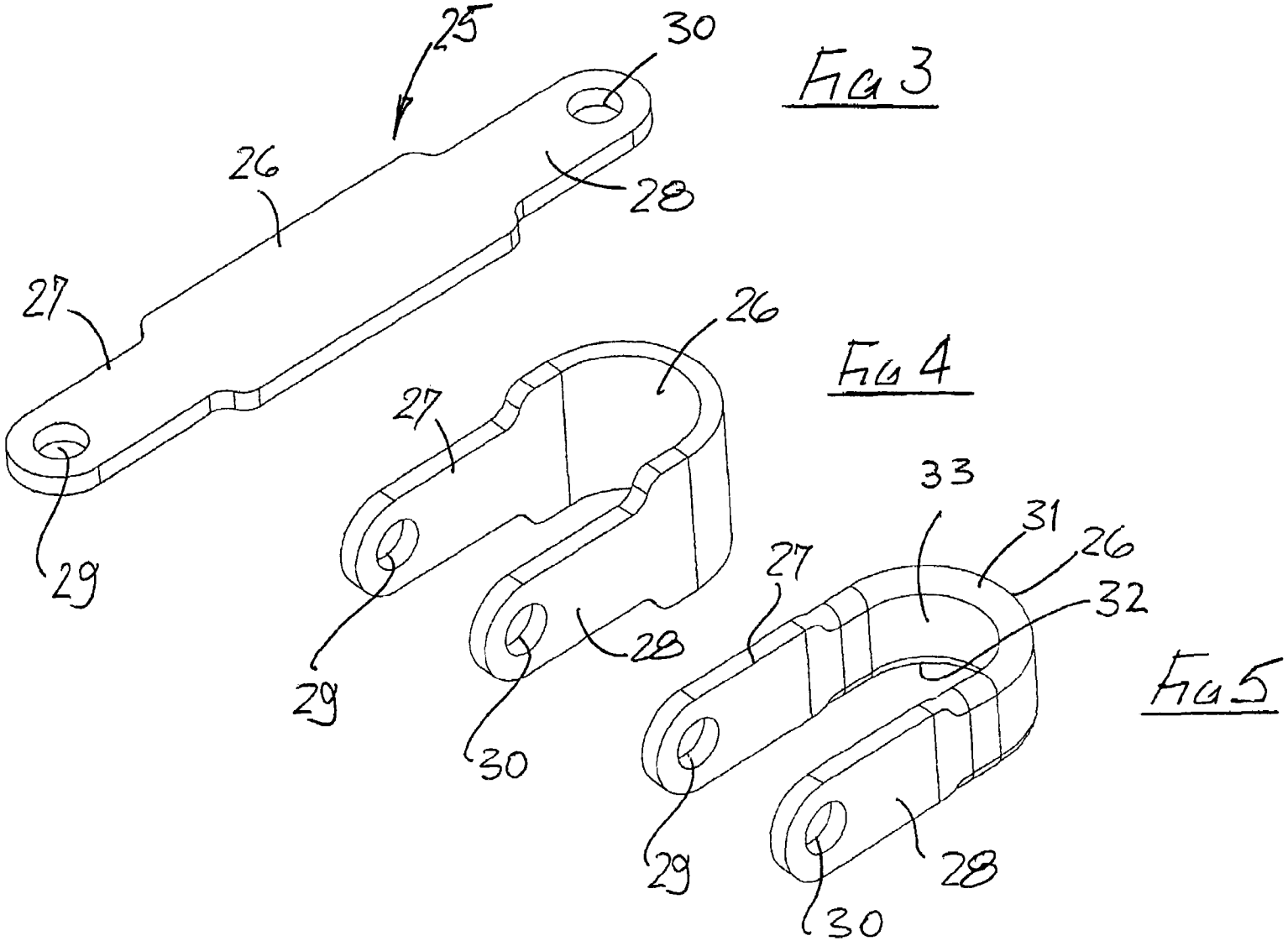
FIGS. 3 to 5 show the process of manufacturing a strap of this invention for use with a pulley block as shown in FIG. 1 or FIG. 2.

Referring now to FIGS. 3 to 5, there is shown a forming process for a strap of this invention, intended particularly for use with a block such as that shown in FIG. 2. A blank 25 is cut from a strip of stainless steel by a stamping operation, that blank having a central region 26 and a pair of end portions 27, 28 extending in alignment, one from each end of the central region 26. As shown, the central region 26 of the blank has a greater width in the transverse direction than the width of the end portions 27, 28. Simultaneously with the stamping of the blank, there are formed two holes 29, 30 adjacent the ends of the end portions 27, 28. Though the end portions 27, 28 are shown as essentially linear, they may be otherwise profiled, to interact with formations on the side cheeks of the block with which the finished strap is to be used.

The stamped blank of FIG. 3 is bent to take up a symmetrical U-shaped form, as shown in FIG. 4. Typically, this is achieved by over-bending the blank around a former of a slightly smaller radius than that required for the finished strap, whereby on removal of the bent blank from the former, the metal springs back to some extent resulting in the end portions 27, 28 extending substantially parallel to each other, with the holes 29, 30 in alignment.

Figure 6:
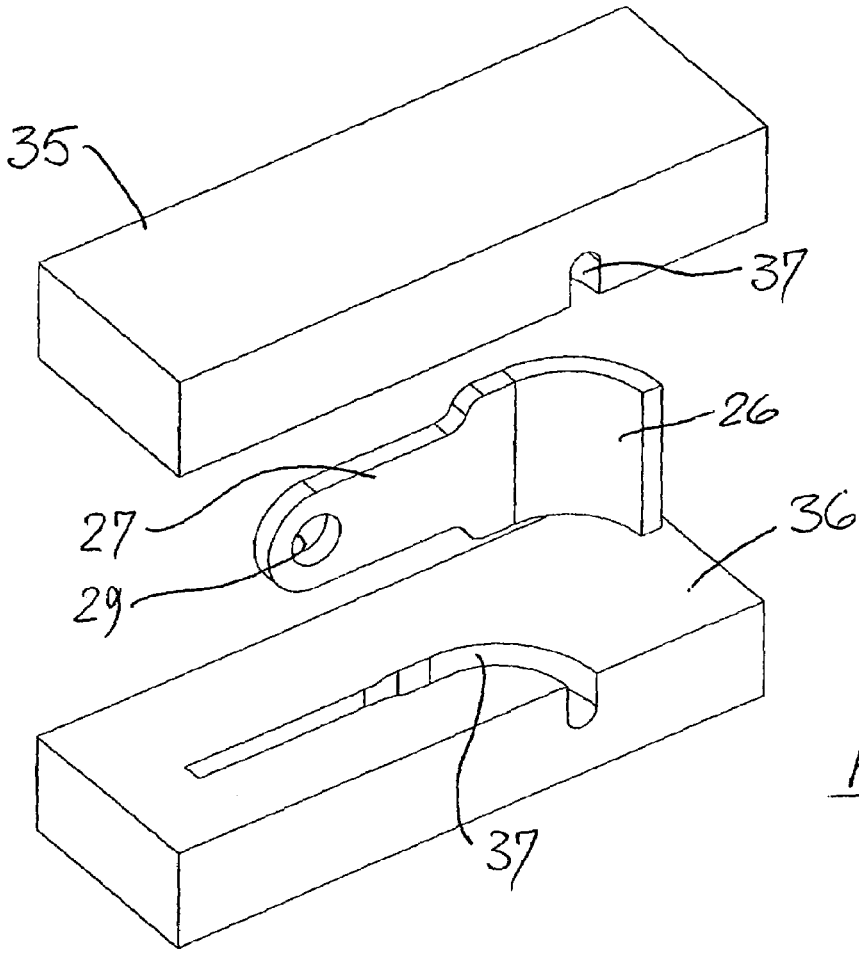
FIG. 6 shows diagrammatically parts of upper and lower dies and a part of a strap as shown in FIGS. 3 to 5, before processing in the dies.

The U-shaped blank of FIG. 4 is then placed in a two-part die provided on a press and is subjected to a cold-forming operation by rapid closing of the press, such that the transverse width of the central region 26 of the blank is reduced to slightly less than the width of each end portion 27. FIG. 6 shows a part only of upper and lower dies 35, 36 used to perform the cold-forming operation on the strap. Each die part 35, 36 has a groove 37 formed therein and adapted to reduce the width of the central region 26 of the strap, while merely holding each end portion 27. The die constrains the end portions of the blank so that the cold-forming operation does not significantly increase the length of the central region; rather, the cold-forming operation causes the metal to flow plastically within the die to increase the thickness of the central region, as shown in FIG. 5. Simultaneously with this, the edges 31, 32 of the strap are formed to have a radiused profile, while the internally-directed face 33 of the central region 26 remains substantially flat, as shown in FIG. 5.

Provided that a suitable grade of stainless steel is selected for the manufacture of the strap, such as an 18/8 austenitic stainless steel, the cold-forming operation in the die subjects the strap to work-hardening, so increasing the strength of the steel.

Following completion of the strap, it is fitted to the body of a pulley block already having a sheave rotatably mounted between the cheeks thereof, by means of a pin 15 extending through the holes 29, 30 of the strap and also through an aligned hole in the pulley body, the ends of the pin 15 then being peined over to retain the assembly together, as described above.

Figure 7:
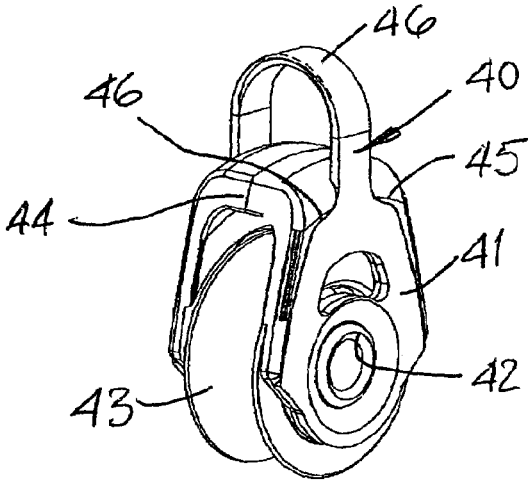
FIGS. 7 and 8 respectively show single and double pulley blocks each incorporating a strap of this invention.
Figure 8:
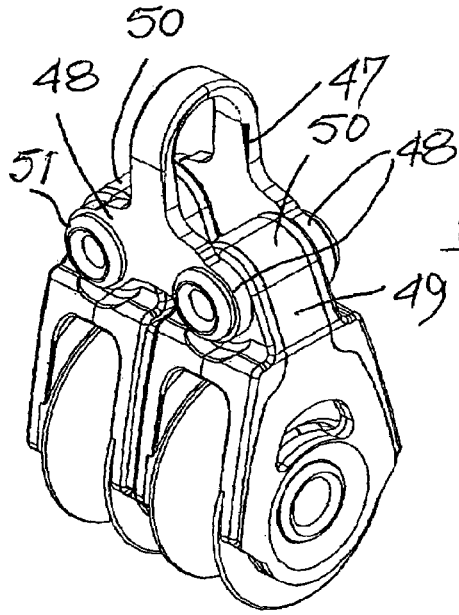

FIGS. 7 and 8 show examples of two pulley blocks each incorporating an embodiment of strap of this invention. In the case of FIG. 7, the strap 40 is formed to have enlarged end portions 41 with a central bore through which extends a spindle 42 for supporting the sheave 43 of the block. The bridging region 44 of the block is profiled so as to engage shoulders 45 formed on the strap, where the end portions 41 merge into the base section 46 thereof.

In the case of the double block of FIG. 8, the strap 47 is differently profiled so as to have a pair of laterally-projecting arms 48 each of which is provided with a hole. The double block has a pair of similar half-blocks each of which is provided with a strap 49 generally similar to that of FIG. 7, except that the central region 50 thereof may be formed conventionally and fits closely to a corresponding formation on the block, a through-hole being provided in that formation. The arms 48 of the strap 47 fit to the two formations and hollow rivets 51 extend through the holes in the arms 48 and through the holes in the block formations.

As will be appreciated, if a shackle is used to connect a pulley block fitted with the strap to some other component, there will be a relatively large linear bearing area between the pin of the shackle and the flat face 33 of the central region of the strap. Conversely, if a cord is used to tie the block to some other component, the radiused edges 31, 32 of the strap will significantly reduce the stress on a cord, so reducing the likelihood of early failure of that cord. The arrangement of the narrower central region of the strap together with its cross-sectional profile allows increased articulation for the block when connected to some other component, in this way.

The invention is not limited to the particular details of the foregoing description. Variations of the strap-forming process are within the competence of those skilled in the art, and also the kind of pulley block with which the formed strap may be used is not to be regarded as limited to those shown in the drawings.

The invention claimed is:

1. A method of forming a U-shaped strap for a pulley block, comprising:

providing a blank of metal strip having an elongate central region with two ends and long edges extending between said ends, and two end portions extending one from each of the two opposed ends respectively of the central region;

bending the blank round into a U-shape so that the central region is arcuate and the two end portions are substantially parallel; and subsequent to the bending, subjecting the central region to a cold-forming operation in a direction transverse to the long edges of the central region to reduce the width of the central region and to provide a radius to the long edges thereof.

2. A method as claimed in claim 1, wherein the thickness of the central region is increased during the cold-forming operation.

3. A method as claimed in claim 1, wherein the width of each end portion of the metal blank before the cold-forming operation is narrower than the width of the central region thereof.

4. A method as claimed in claim 3, wherein at the completion of the cold-forming operation the width of the central region is no greater than the width of the two end portions.

5. A method as claimed in claim 4, wherein at the completion of the cold-forming operation the width of the central region is less than the width of the end portions.

6. A method as claimed in claim 1, wherein the central region of the strap has a surface directed inwardly of the arcuate U-shape after the cold-forming operation, said surface being formed in the cold-forming operation to be one of substantially flat and substantially concave, transversely between the radiused edges thereof.

7. A method as claimed in claim 1, wherein the cold-forming operation is performed in a die having the required finished shape of the central region of the strap.

8. A method as claimed in claim 7, wherein the cold-forming operation is performed between cooperating die parts which together define a cavity having the required profile of central region of the finished strap.

9. A method as claimed in claim 1, wherein the blank is cut from a metal which is susceptible to work-hardening, whereby the central region of the finished strap displays greater strength than the strip-like blank before forming.

10. A method as claimed in claim 1, wherein each end portion of the blank is profiled so that at completion of the strap each end portion may interact with a formation provided on a side cheek of a pulley block.

11. A method as claimed in claim 1, wherein a U-shaped strap is produced for a pulley block, the pulley block having a pair of side cheeks between which is mounted a rotatable sheave, and the U-shaped strap having end portions connected one to each cheek respectively and an arcuate central region conjoining the end portions.

* * * * *